US011006689B1

(12) United States Patent
Nowak et al.

(10) Patent No.: US 11,006,689 B1
(45) Date of Patent: May 18, 2021

(54) HARD HAT AND FACE SHIELD

(71) Applicants: Mark T. Nowak, Lodi, CA (US); Mark A. Nilsen, Stockton, CA (US)

(72) Inventors: Mark T. Nowak, Lodi, CA (US); Mark A. Nilsen, Stockton, CA (US)

( * ) Notice: Subject to any disclaimer, the term of this patent is extended or adjusted under 35 U.S.C. 154(b) by 169 days.

(21) Appl. No.: 16/192,289

(22) Filed: Nov. 15, 2018

Related U.S. Application Data

(60) Provisional application No. 62/588,368, filed on Nov. 19, 2017, provisional application No. 62/689,683, filed on Jun. 25, 2018, provisional application No. 62/717,998, filed on Aug. 13, 2018.

(51) Int. Cl.
*A42B 3/20* (2006.01)
*A42B 3/08* (2006.01)
*A42B 3/32* (2006.01)

(52) U.S. Cl.
CPC ..... *A42B 3/20* (2013.01); *A42B 3/08* (2013.01); *A42B 3/32* (2013.01)

(58) Field of Classification Search
CPC .... A42B 3/08; A42B 3/18; A42B 3/20; A42B 3/32; A42B 1/004; A63B 71/10
USPC ..... 2/9, 410, 411, 416–418, 424, 455; 128/857, 858
See application file for complete search history.

(56) References Cited

U.S. PATENT DOCUMENTS

| | | | | |
|---|---|---|---|---|
| 6,499,139 | B1 * | 12/2002 | Brown | A42B 3/20 2/9 |
| 6,708,339 | B1 * | 3/2004 | Smith, Jr. | A42B 3/20 2/425 |
| 7,430,763 | B1 * | 10/2008 | Santos | A42B 3/20 2/424 |
| 2011/0061152 | A1 * | 3/2011 | Wismann | A42B 3/20 2/424 |
| 2011/0252543 | A1 * | 10/2011 | De Harde | A42B 3/20 2/411 |

FOREIGN PATENT DOCUMENTS

| | | | | |
|---|---|---|---|---|
| GB | 2542429 | * | 3/2017 | A42B 3/20 |

* cited by examiner

*Primary Examiner* — Katherine M Moran
(74) *Attorney, Agent, or Firm* — Heisler & Associates

(57) ABSTRACT

A face protection system is provided in the form of a face shield attachable to a hard hat. An upper portion of the face shield includes at least one loop surrounding at least a portion of an opening. The opening is sized to allow at least a portion of a dome of the hard hat to fit upward therethrough, but small enough to keep the entire hard hat from passing therethrough, so that the upper portion of the face shield rests upon the hard hat. A mask extends down from the upper portion of the face shield and preferably includes a plurality of columns on a front side thereof in front of a face of a wearer of the hard hat. Preferably ribs extend laterally between the columns, with the columns and ribs together forming the mask. A visor can optionally be placed inboard of the mask.

18 Claims, 7 Drawing Sheets

HARD HAT AND FACE SHIELD

CROSS-REFERENCE TO RELATED APPLICATIONS

This application claims benefit under Title 35, United States Code § 119(e) of U.S. Provisional Application No. 62/588,368 filed on Nov. 19, 2017, U.S. Provisional Application No. 62/689,683 filed on Jun. 25, 2018 and U.S. Provisional Application No. 62/717,998 filed on Aug. 13, 2018

FIELD OF THE INVENTION

The following invention relates to protective gear for protecting a face of a wearer. More particularly, this invention relates to headgear especially that which is attachable to a construction worker hard hat, which provides protection for a face of a wearer of the hard hat.

BACKGROUND OF THE INVENTION

In the construction industry and related industries, a common item of headgear is the "hard hat." A primary purpose of the hard hat is to protect the wearer's head from objects falling from above. Hard hats generally have a hemispherical dome sized to fit over and slightly above the head of a wearer. The hard hat also has a brim which diverges laterally from a lower edge of the hemispherical dome. This brim can extend horizontally, but typically extends somewhat downwardly in a diagonal manner away from the lower edge. Some hard hats include a brim which circumscribes the hemispherical dome, while other hard hats include the brim only on a forward portion, or otherwise with the brim extending in an asymmetrical manner from the hemispherical dome. The hard hat has a hollow interior which typically includes head supporting structure therein which is often adjustable to fit directly against the head of a wearer and suspend the hemispherical dome somewhat above the head of the wearer. Padding is also often associated with an interior of the hard hat. Typically a hard hat does not include any form of chinstrap.

Construction workers and other hard hat wearing workers often utilize other protective equipment upon the head. Such protective equipment can include goggles, other protective eyewear, ear protection, visors, breathing masks, and other accessories. Most typically these protection structures are provided separate from the hard hat. This allows a worker to utilize their personal hard hat with a variety of different additional protection equipment, depending on the work being performed and the hazards being encountered. While many additional safety accessories can be readily worn along with the hard hat, without either the hard hat or the accessory interfering with each other, other accessories to some extent take up space used by the hard hat, so that some integration therebetween is called for, or some other accommodation or modification is necessitated.

Visors are known to be provided as safety equipment worn over a face of a worker. Such visors can be formed of clear solid material or formed of a woven material with fenestrations therein. A primary purpose of the visor is to protect eyes of the wearer from being impacted by small items, such as those which often fly at the worker when the worker is performing some cutting operation or similar task. The small lightweight items flying at the worker impact the visor and are deflected away from the eyes of the wearer. Such a visor also can protect the face of the wearer more generally. Another goal of the visor is to allow the wearer to still be able to see a work area clearly through the visor.

One form of hazard encountered by construction workers and other similar workers is the risk of a cutting tool "kicking back" at the worker, especially when the cutting tool encounters an object during cutting which has a different hardness or other character, or when the cutting tool malfunctions somehow, such as when a chain comes off of a chainsaw, or a grinder or concrete cutting tool encounters reinforcing bar, hard aggregate within cementitious material, or other elements of varying hardness embedded within the workpiece being cut.

When such a tool kicks back at the worker, a worker needs to resist the motion of the tool quickly and strongly to keep the cutting tool from impacting the worker, especially the head and neck area of the worker. The head of the worker can be impacted by such a cutting tool if the speed and forces of the kickback exceed what can be effectively resisted by the worker, causing the cutting tool to impact the head of the worker. A visor is not designed to resist forces associated with the cutting tool coming into contact with the visor, but rather is only designed to deflect small pieces of material which may fly from a cutting tool toward the head of the worker. Accordingly, a need exists for a face shield accessory, and especially a face shield accessory which is configured to resist forces encountered by contact with a cutting tool such as a grinder, concrete cutting saw, chainsaw, chop saw or similar high power cutting tool kicking back at a head of a worker.

SUMMARY OF THE INVENTION

With this invention, a face shield is provided which is configured to cooperate with hard hats of various different styles, so that a worker can still utilize the hard hat with which the worker is familiar, and also have the benefit of a face shield for added protection, especially when utilizing a high power cutting tool, such as a concrete cutting saw, grinder, chainsaw, oversize skill saw or similar hand held high strength cutting tool (other uses for the shield can also be provided as well). In one embodiment of the invention, the face shield is configured to be somewhat universal in form in that it can attach to hard hats of different configurations and sizes, so that the face shield acts as an accessory which can be utilized with various different workers having different hard hats. Because the face shield does not come directly into contact with the wearer, it can be an auxiliary piece of safety equipment which can be readily shared between workers without concern for surfaces thereof coming into contact with multiple workers and presenting potential for cross-contamination between workers.

In one embodiment provided as an example, the face shield includes a wire cage structure with individual wires of a sufficiently thick gauge and formed of a metal of sufficient hardness and strength that they resist appreciable bending or being cut through, when struck by a cutting tool kicking back against the face shield. A mild steel wire of 3/16 inch diameter provides one such example. This wire could be sized down to 1/8 inch diameter or even perhaps 1/16 inch diameter, depending on strength characteristics desired and the type of steel or other material from which the wire is formed. It is also conceivable that the wire could be larger diameter, such as up to 1/4 inch or larger, if desired.

To facilitate attachment to the wearer, through the hard hat, the upper portion of the face shield includes a pair of loops including a top loop and a second loop in one example upper portion. These two loops are generally concentric with each other and spaced apart by lateral elements which extend radially between the top loop and the second loop. The top loop has a smaller diameter than the second loop. The lateral elements have lengths which space this second loop from the top loop. These lateral elements also preferably extend diagonally downwardly somewhat, and most preferably at an angle which is similar to that which is commonly provided by an angle of a brim of a typical hard hat. As one example, this angle is 30° below horizontal as the lateral elements extend away from the top loop and toward the second loop. The lateral elements can be provided in various different numbers, with one embodiment involving between four and six such lateral elements. The lateral elements also provide effective rigidity and strength to the face shield in this embodiment. These loops can be similar wires to those forming the face shield or different wires or not made of wire, and the two loops could alternatively be one loop or more than two loops.

In this example, the top loop has a diameter similar to a diameter of a lower edge of the hemispherical dome of a typical hard hat. The second loop has a diameter similar to a diameter of a perimeter edge of a brim of a typical hard hat. An interior of the top loop is left open and defines the opening of the upper portion. Thus, the dome of the hard hat can fit up through the opening in the top loop, with the brim of the hard hat beneath the lateral elements and beneath the top loop. The top loop and second loop of the face shield, as well as the lateral elements, thus easily rest upon the brim of the hard hat and surrounding the dome thereof.

Even if the hard hat only has a brim on a forward portion thereof, the face shield can still be held in place by gravity merely resting upon the brim. However, to prevent excessive movement of the face shield relative to the hard hat, a fastener can be provided at a rear edge of the hard hat for holding a rearward portion of the face shield, typically the top loop, adjacent to a rear portion of the hard hat. To further rest upon various hard hats with differing brims, the top loop can be made slightly smaller than the perimeter of the dome of the hard hat so that the hard hat cannot fit through the top loop, so that the top loop is held upon the dome rather than the crease, but near a lower perimeter edge thereof.

Forward portions of the face shield define a mask and in one embodiment include further wire elements including columns which in one example extend generally vertically and ribs which in one example extended generally horizontally in a grid pattern on a forward side of the face shield and beneath the second loop. These columns and ribs are provided as one form of a mask extending in a downwardly extending direction, but preferably curve in a cylindrical fashion generally about a centerline along with a center of the top loop and second loop. The columns and ribs can be welded together at intersections thereof, or otherwise fastened together to provide rigidity to the columns and ribs further reinforcing each other.

To further keep the face shield securely in position upon the hard hat, a chinstrap is preferably provided attached to lateral sides of the second loop and with sufficient length and adjustability and a removable connector, to allow such a chinstrap to pass under a chin of a wearer and to be tightened, securing the face shield by pulling down on the hard hat and under the chin of the wearer. The hard hat and face shield is held firmly in place, and ready to encounter an unexpected impact from a cutting tool and to provide protection therefrom.

Most preferably, a visor of some form, such as a mesh element or solid clear material (such as polycarbonate), is provided which can attach to the face shield and protect the wearer from the small particles which often fly out from a work piece during cutting thereof. In one embodiment shown herein, the face shield includes inwardly extending pivoting posts with an asymmetrical shape. A mesh element is provided, which includes an upper band and a perimeter band below the upper band and with a mesh layer between the upper band and the perimeter band. Post port holes are provided in the upper band at lateral portions of the mesh element, with the spacing therebetween matching the space in-between pivoting anchors on an interior of the face shield. These fastener ports are sized and shaped so that the pivoting anchors can pass through in one orientation, and the pivoting posts can be rotated to lock the mesh element in position directly inboard of the face shield. In a similar manner, other forms of visors could be attached to an interior of the face shield. Alternatively goggles or other face protection for fine particles could be worn inboard of the face shield.

The resulting assembly includes primarily only one structure which comes in contact with the wearer, and that being a wearer's own hard hat (and optionally part of the chin strap). The face shield acts as an accessory for the hard hat which can be removably attached to the hard hat, with only the chinstrap potentially coming into contact with different users of the face shield. If desired, this chinstrap could be replaceable or formed of material which can be readily sanitized, or could have a removable cover which could be used once and disposed of.

The number of columns and ribs in the face shield can vary, with one example including five columns including a central column, two side columns, and two intermediate columns, with the columns generally at equally spaced distances from each other. In one embodiment a number of ribs includes three ribs, including an upper rib, and middle rib, and the lower rib, the lower rib curving as an extension of the two side columns, and then defining a lowermost edge and perimeter of the mask portion of the face shield. While in one embodiment each of these wires forming each of the columns and ribs is of a similar gauge and material, as an alternative, wires having different gauges could be utilized, or wires formed from different materials could be utilized, such as to provide greater strength for the ribs, as the ribs are most likely to encounter a cutting tool during kick back.

While this invention has been described above in the context of an accessory for a hard hat, it is conceivable that the face shield could be integrated into a hard hat like hat or other headgear, and be provided as a single unit, rather than as an accessory for a hard hat. In such an embodiment, the face shield would merely be affixed (either temporarily or permanently) to the hard hat or other head gear. Similarly, the visor could optionally be permanently affixed to the face shield, rather than being removable as described above.

In one embodiment, the face shield can be modified to be particularly optimized for a hard hat having a brim on only a forward portion of the hard hat (the brim, when only on the front, is referred to herein as a "bill"). The hard hat face shield described above could fit on such a hard hat having a bill on a forward portion thereof, but without any brim-like structure all the way around the perimeter, without modification. Such function could occur primarily by having an uppermost loop slightly smaller than the hard hat. Most preferably, however, when the hard hat has a bill on the front, and no circumscribing brim, an alternate face shield is provided which is optimized for use with such a "baseball cap style" hard hat with a bill.

The alternate hard hat face shield is, in one embodiment, formed of individual wires bonded together, typically by welding, with a slightly different configuration than that depicted herein and described above for hard hats having a circumscribing brim. An inner top loop preferably provides a complete circuit and is sized slightly smaller than a lower edge of a dome of the alternate hard hat. Thus, the dome of the alternate hard hat can fit up through this inner top loop, but the entire alternate hard hat cannot fit through this inner top loop. Most preferably, the inner top loop is slightly oval-shaped to match a perimeter shape of the dome of the alternate hard hat at a lower edge thereof.

A front loop segment is provided which is slightly below a plane in which the inner top loop is oriented, and with the front loop segment only on a forward portion of the face shield. This front loop segment is sized and shaped so that it generally follows a front edge of the bill of the alternate hard hat. This front loop segment is slightly lower than the inner top loop, so that it can follow the perimeter of the bill of the alternate hard hat when the inner top loop rests at a transition between the bill and the dome of the alternate hard hat. Preferably, at least one lateral element (and typically multiple lateral elements) spans a space between the front loop segment in the inner top loop, to provide secure support for the front loop segment to the inner top loop.

The alternate hard hat face shield further includes a mask which in one form includes a series of columns and ribs, which can be generally perpendicular to each other, with the columns extending vertically and the ribs extending horizontally. Orientation of these columns and ribs could be adjusted slightly, but with the columns closer to vertical then to horizontal and with the ribs oriented closer to horizontal than to vertical. Intersections between the ribs and columns can be joined together, such as by welding the ribs and columns together. Upper ends of the columns are preferably welded or otherwise attached to the front loop segment, and extending substantially vertically downward from this front loop segment, but typically curving inwardly somewhat. The ribs preferably curve so that between tips the ribs form approximately a half circle, and can be generally located in planes parallel with adjacent ribs below the front loop segment. If desired, lower ribs can be slightly smaller in radius than upper ribs, so that the face shield tends to taper inwardly as it extends downwardly, somewhat.

Each of the columns and ribs, as well as the wire segments forming the inner top loop and the front loop segment, are preferably all formed from a similar steel material. This material is typically circular in cross-section so that it is generally in the form of heavy wire. An approximate diameter of this wire is about 3/16 inch in one embodiment. Most preferably, and to provide desirable rigidity for the face shield, the inner top loop is slightly thicker in diameter than other portions of the face shield. For instance, the inner top loop preferably has a thickness between 3/16 inch and 7/32 inch. The remaining wire elements of the face shield preferably have a diameter between 5/32 inch and 3/16 inch. These sizes are illustrative of one embodiment of this invention, but could be scaled larger or smaller in other embodiments of this invention.

The face shield could be formed of other materials, and having other dimensions, provided that the elements have sufficient strength that they can resist a blow from coming in contact with a heavy duty cutting tool such as a high power grinder, concrete saw, chop saw, or other powerful cutting tool, without quickly cutting through the face shield. In this way, a quick kick back of the face shield is resisted by the face shield, saving the wearer from injury.

One alternative material could be injection molded plastic. The plastic can be provided with filaments to add strength thereto. If formed of plastic, the ribs and columns typically are not circular in cross-sectional form, but rather are enlarged in an inward/outward horizontal direction to add strength, but to avoid additionally blocking vision of the wearer through the face shield.

A pair of strap loops are preferably provided extending down from the inner top loop at lateral sides of the inner top loop and slightly to the rear of the front loop segment. Straps such as those described in detail above can attach to these strap loops and extend down under a chin of the wearer. The straps provide a downward force on the alternate hard hat face shield, tending to keep the face shield firmly upon the hard hat. A visor as described above would also typically be attached to the face shield.

While the alternate hard hat face shield is typically merely resting upon the hard hat, as an alternative, various fasteners could be utilized to secure the face shield to the hard hat. Such fasteners could be provided especially adjacent to a lower edge of the hard hat and allow for coupling (either permanently or removably) to the inner top loop of the face shield, so that the face shield can be even more firmly and securely attached to the hard hat.

OBJECTS OF THE INVENTION

Accordingly, a primary object of the present invention is to provide an attachment to a hard hat which provides a face shield to protect against dangerous items impacting a face of a hard hat wearer.

Another object of the present invention is to provide a face shield to protect a face of a hard hat wearer, regardless of the type of hard hat worn by the wearer.

Another object of the present invention is to provide a face shield for a hard hat which can also accommodate a visor for protection of the face of the wearer from small items.

Another object of the present invention is to provide a face shield which can be provided for use with various hard hats, and so that an individual can use an existing hard hat with the face shield, and so that the face shield can potentially be shared between users without users needing to share the hard hat.

Another object of the present invention is to provide a face shield which is easy to secure in place in front of the face of a wearer.

Another object of the present invention is to provide a face shield for a hard hat which is strong enough to protect against strikes by a saw when it kicks back, and other similar dangerous strikes to the face of the wearer.

Another object of the present invention is to provide a combined hard hat and face shield for protecting a face of a wearer.

Another object of the present invention is to provide a method for protecting a face of an individual.

Other further objects of the present invention will become apparent from a careful reading of the included drawing figures, the claims and detailed description of the invention.

DESCRIPTION OF THE PREFERRED EMBODIMENT

Figure 2:
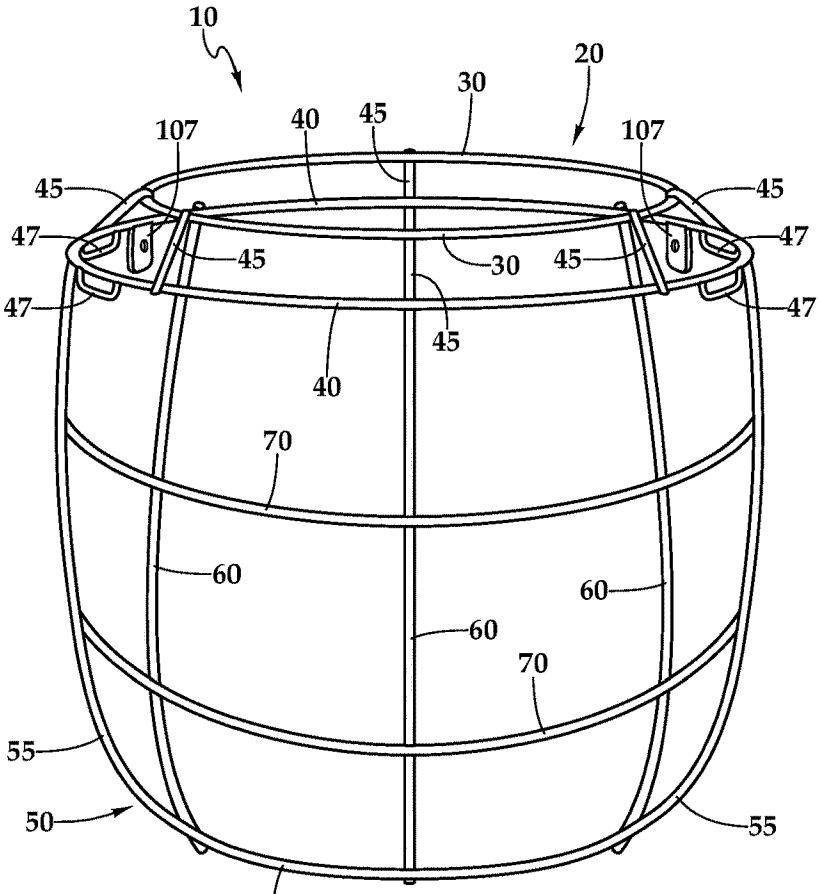
FIG. 2 is a rear elevation view of the face shield of FIG. 1, without the hard hat or visor shown.

Referring to the drawings, wherein like reference numerals represent like parts throughout the various drawing figures, reference numeral 10 (FIGS. 1-6) is directed to a face shield which is conveniently removably attachable to a hard hat H. Most preferably, the face shield 10 or an alternate face shield 110 (FIGS. 9-14) fits upon either a hard hat H having a brim B circumscribing a perimeter of the hard hat H, or a hard hat H having a more prominent bill V on a forward portion of the hard hat H. The face shield 10 extends down through a forward portion of the hard hat H, to protect a face of a wearer of the hard hat H from being struck by objects approaching the face of the wearer from the front.

In essence, and with particular reference to FIGS. 1 and 4-6, basic details of the face shield 10 are described, according to a representative embodiment. The face shield 10 includes an upper portion 20 configured to engage a hard hat H. The upper proportion 20 in this embodiment includes a top loop 30 surrounding an opening 35. A dome D of the hard hat H extends up through this opening 35. A second loop 40 is outboard of the top loop 30 and coupled to the top loop 30, with the second loop 40 extending past a perimeter edge of a brim B of the hard hat H. A forward portion 50 of the face shield 10 provides a preferred form of mask for the face shield 10 which extends down from the second loop 40 or otherwise from upper portion 20 of the face shield 10. This forward portion 50 includes a perimeter 55 and is preferably formed of a series of wire elements including columns 60 which preferably extend mostly vertically, and ribs 70 which preferably extend mostly horizontally. A chinstrap 80 can engage lateral sides of the upper portion 20 of the face shield 10 for extension beneath a chin of a wearer of the hard hat H upon which the face shield 10 is positioned. An optional visor 100 can be coupled to the face shield 10 inboard of the forward portion 50 of the face shield 10, with the visor providing protection from facial impact by particles and other debris which can pass through openings in the forward portion 50 of the face shield 10.

Figure 3:
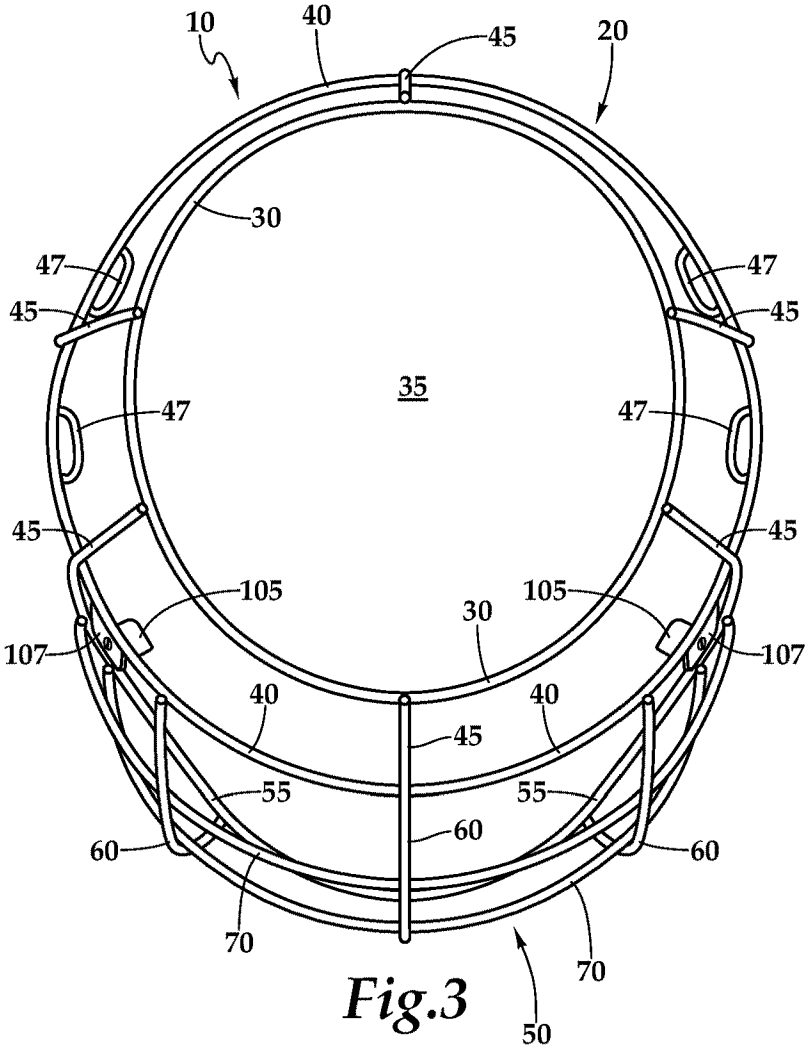
FIG. 3 is a top plan view of the face shield shown in FIG. 1, and without showing the hard hat or visor.
Figures 5, 6:
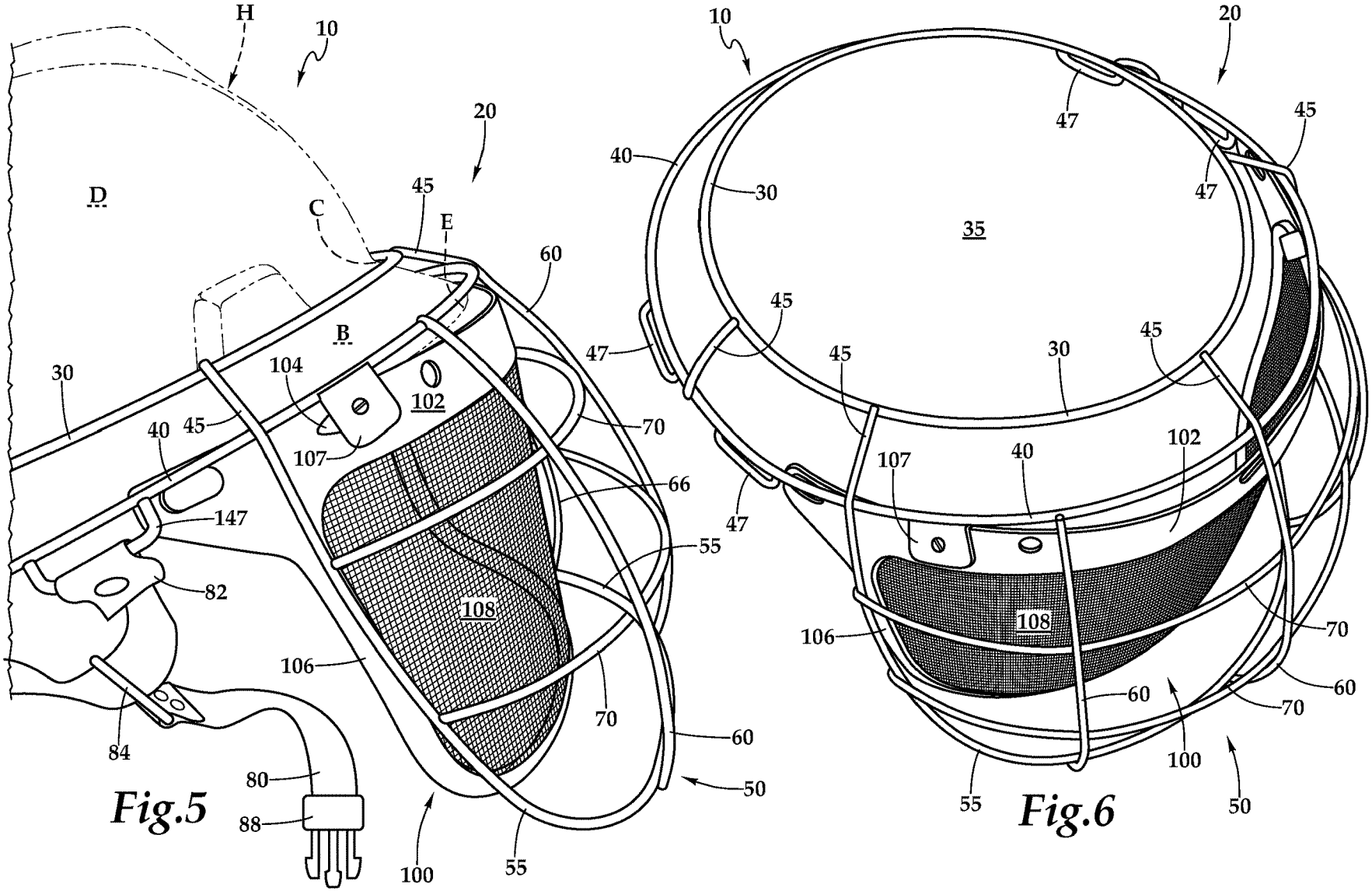
FIG. 5 as a side elevation view of that which is shown in FIGS. 1 and 4.
FIG. 6 is a perspective view from above of that which is shown in FIGS. 1-5, and with the hard hat removed.
Figure 7:
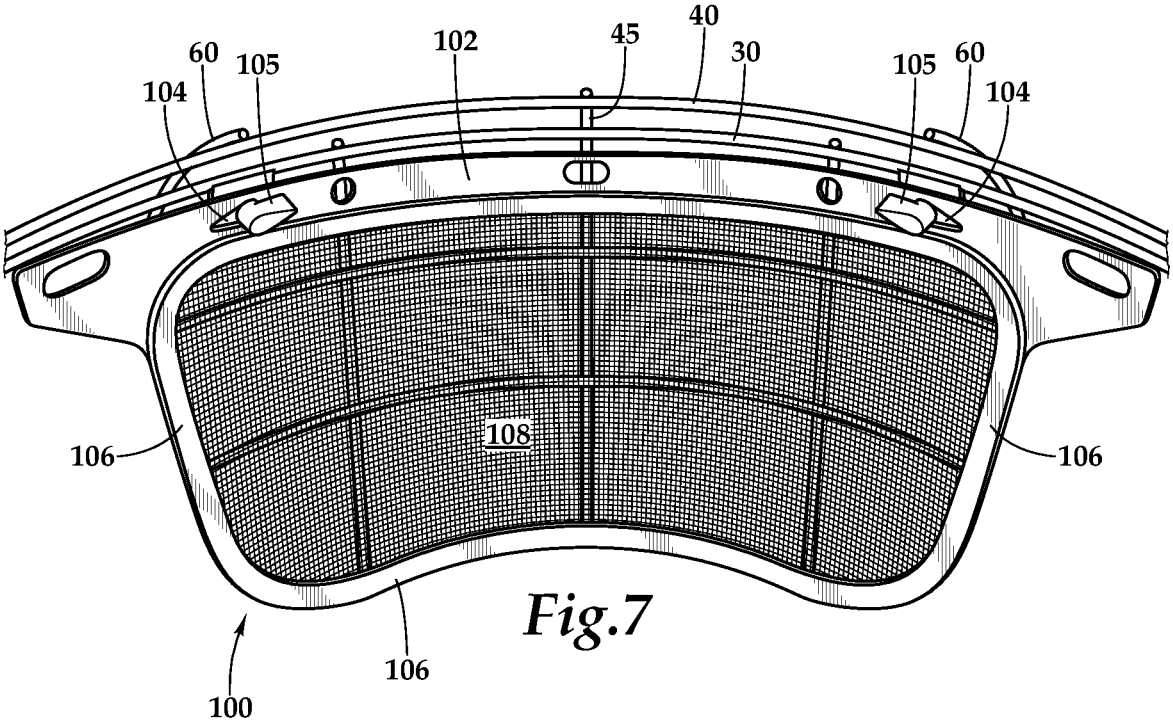
FIG. 7 is a rear perspective view of a portion of the face shield of FIGS. 1-6, and particularly showing a visor accessory which can optionally be attached to the face shield inboard of a mask portion of the face shield.
Figure 8:
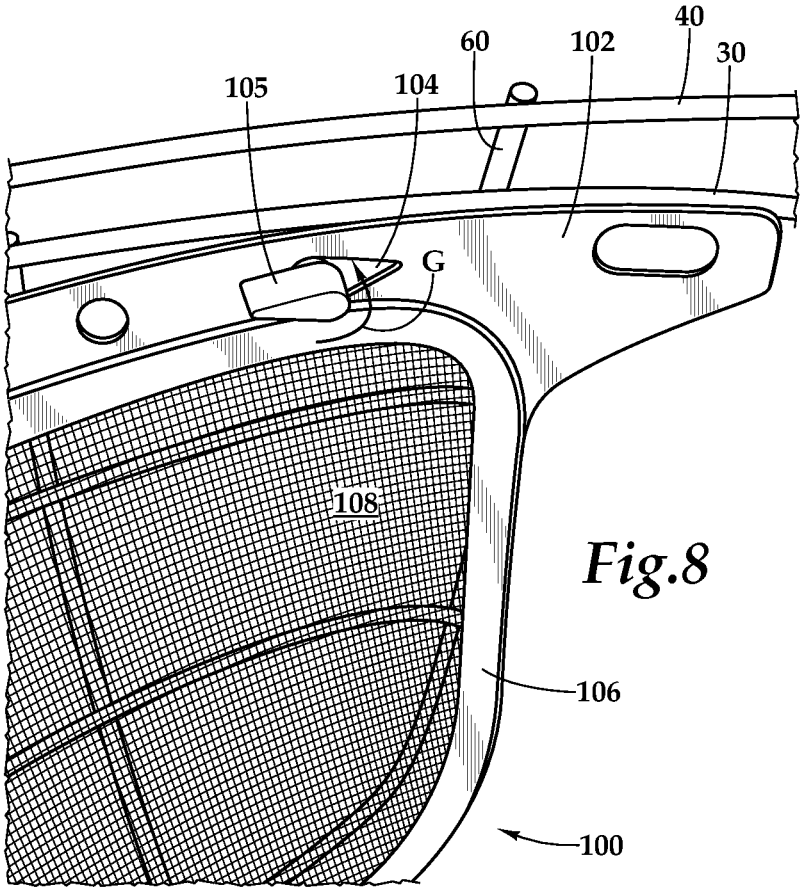
FIG. 8 is a rear perspective view of a portion of that which is shown in FIG. 6, and particularly revealing how fasteners removably hold the visor in position on the face shield.
Figure 10:
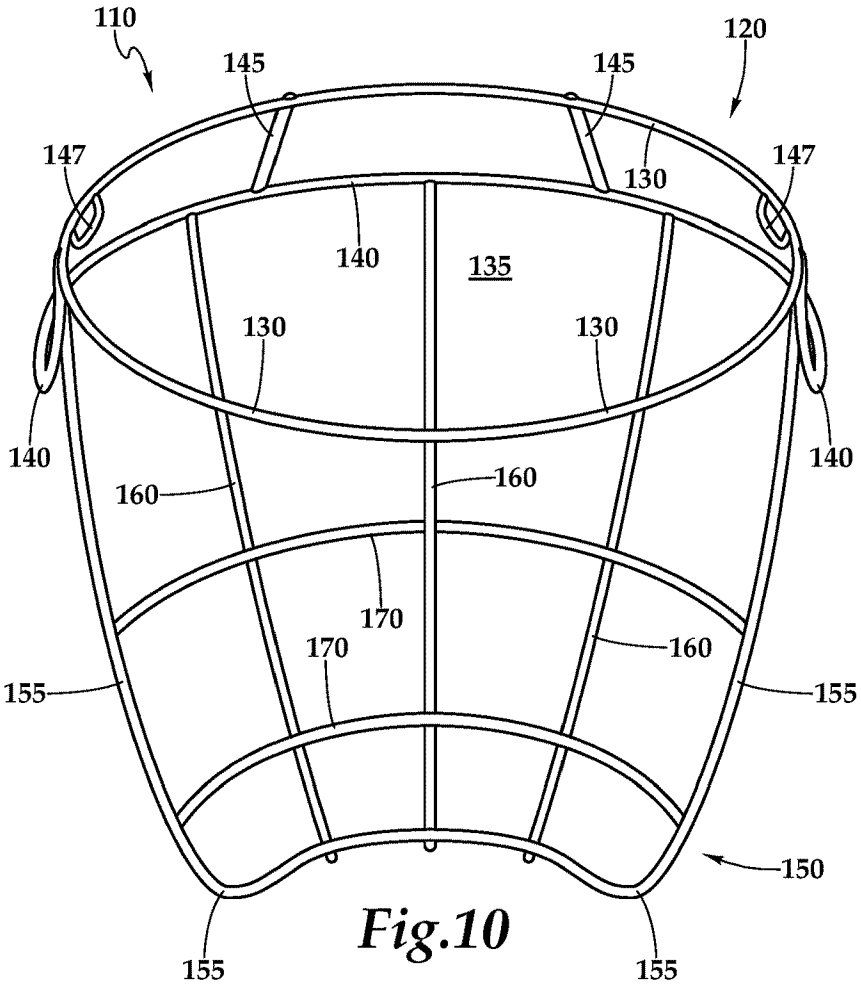
FIG. 10 is a rear elevation view of that which is shown in FIG. 9.
Figure 9:
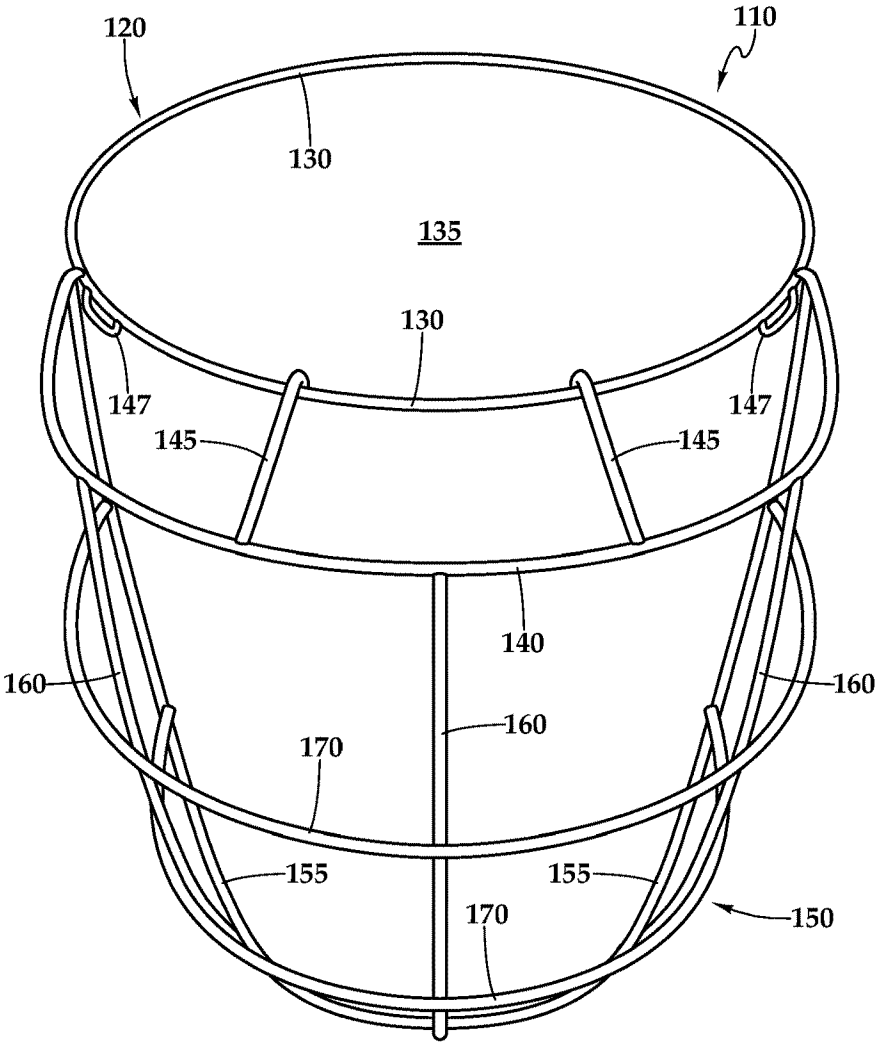
FIG. 9 is a front elevation view of an alternative embodiment of the face shield of FIG. 1, modified to accommodate hard hats which feature a prominent bill as at least a portion of a brim of the hard hat.
Figure 12:
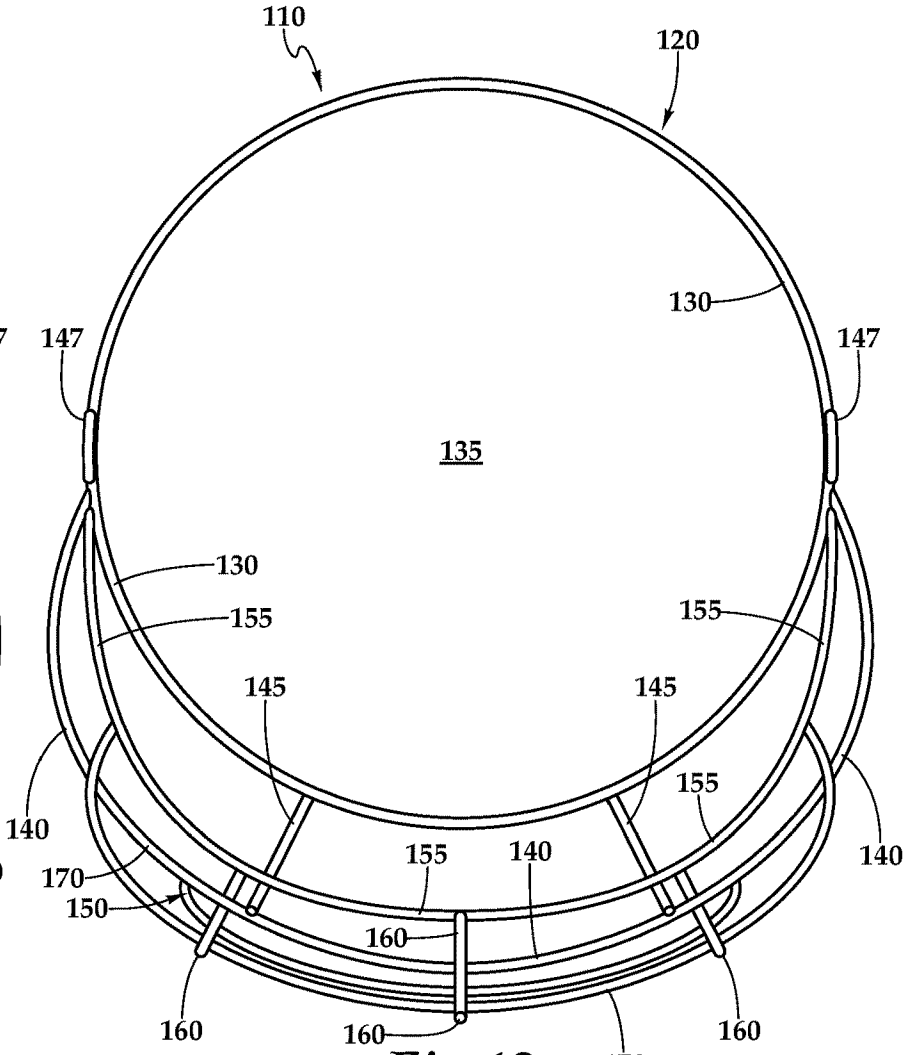
FIG. 12 is a bottom plan view of that which is shown in FIG. 9.
Figure 11:
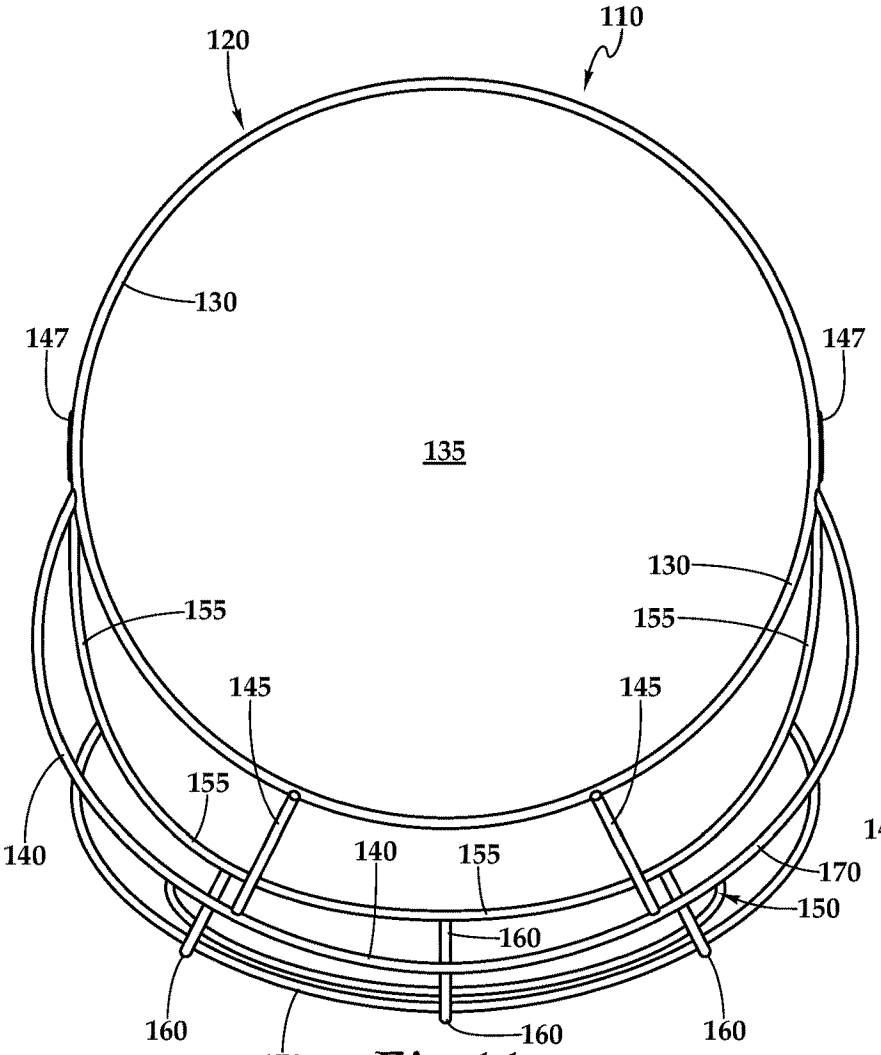
FIG. 11 is a top plan view of that which is shown in FIG. 9.
Figure 14:
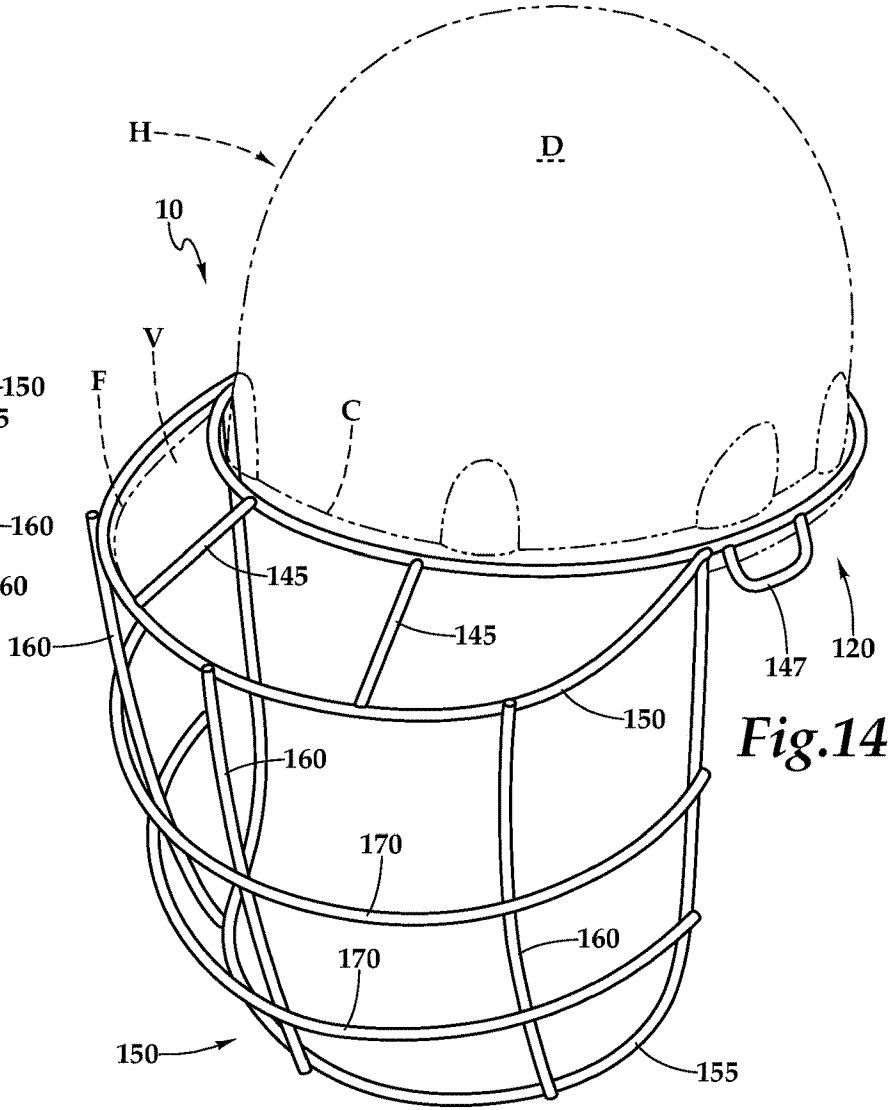
FIG. 14 is a perspective view of that which is shown in FIGS. 9-13 and with a hard hat featuring a prominent bill on a forward portion thereof, shown in broken lines with an alternative embodiment face shield shown upon this hard hat.
Figure 13:
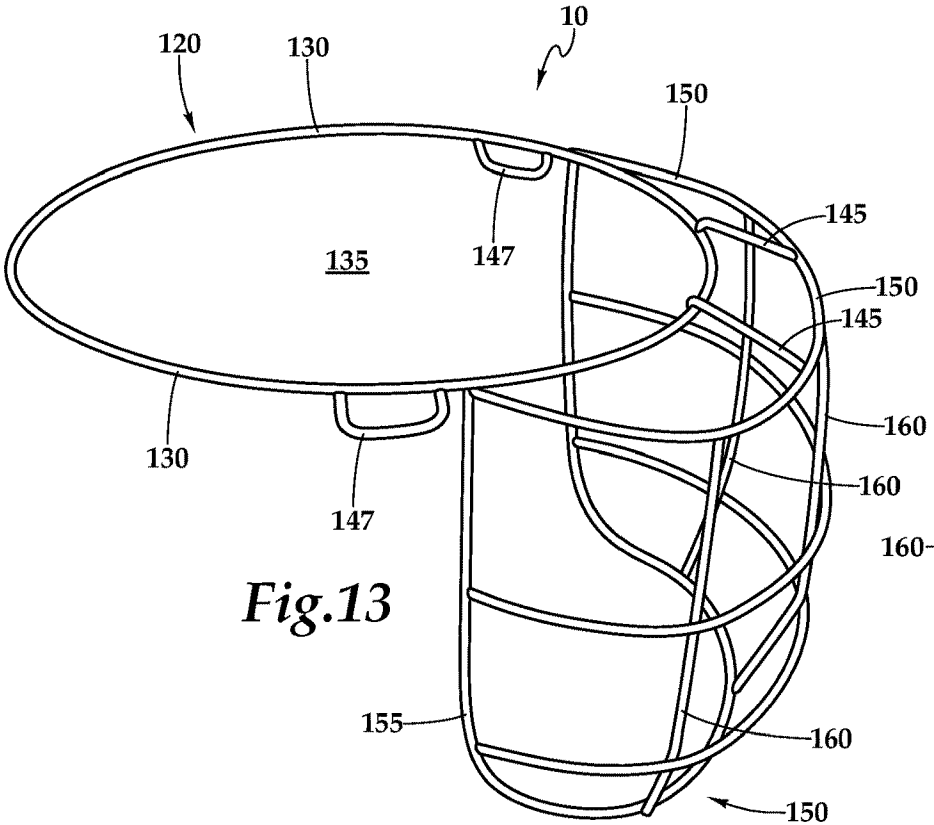
FIG. 13 as a side elevation view, slightly from above a midline, of that which is shown in FIG. 9.

More specifically, and with particular reference to FIGS. 3 and 6, particular details of the upper portion 20 of the face shield 10 are described, according to an exemplary embodiment of the face shield 10, and for engagement with the hard hat H. The upper portion 20 is specifically configured to best fit upon a hard hat H which has a brim B of substantially uniform shape and width, extending laterally from a lower portion of the dome D of the hard hat H. A crease C defines a transition between the brim B and the dome D, with the brim B extending from the crease C to the perimeter edge E, typically at a lesser angle away from horizontal than portions of the dome D above the crease C. This upper portion 20 of the exemplary embodiment could conceivably also work on hard hats H which have a more asymmetrical form, and including a bill B on a forward portion of the hard hat H, with the bill B extending out to a front edge F, as depicted in FIG. 14. Most preferably, however, hard hats H with such a bill B are provided with the alternate face shield 110 (FIGS. 9-14) to best match the geometry of such hard hats H with a bill B.

The upper portion 20 includes a top loop 30 which extends at least partially around an opening 35. This opening 35 is sized to receive at least a portion of the dome D of the hard hat H extending upwardly therethrough, and with the top loop 30 resting upon the dome D or crease C or brim B, or some combination thereof. Most preferably, and in this exemplary embodiment, the top loop 30 completely circumscribes the top opening 35, but the top loop could surround only a majority or other portion of the opening 35. The top loop 30 preferably has a diameter and shape which generally matches a diameter and shape of the crease C of the hard hat H, which is typically an oval that is wider front to back than it is left to right. However, acceptable performance can be provided so long as the top loop 30 has a size which is not larger than the perimeter edge E of the brim B, so that the top loop 30 is prevented from passing entirely over the hard hat H, with a hard hat H extending entirely up through the opening 35 and with no engagement between the upper portion 20 and a hard hat H.

The top loop 30 could be slightly smaller than the crease C, and still function according to this invention, provided that other parts of the upper portion 20 are sufficiently oversized to allow for the forward portion 50 of the face shield 10 to extend downwardly in front of forward portions of the edges of the brim B of the hard hat H.

While the forward portion 50 of the face shield 10 could extend down from the top loop 30, perhaps with some initial lateral extension before extending downwardly, most preferably a second loop 40 is provided surrounding the top loop 30 as an additional part of the upper portion 20. This second loop 40 most preferably completely circumscribes the opening 35 and has a greater diameter than that of the top loop 30, but it could alternatively be less than a full loop. The second loop 40 in this embodiment extends from the top loop 30 with lateral elements 45 extending between the top loop 30 and second loop 40. These lateral elements 45 preferably angle downwardly diagonally from the top loop 30 to the second loop 40, at an angle generally matching an angle of an upper surface of the brim B of the hard hat H.

Both the top loop 30 and second loop 40 are shown in this exemplary embodiment as form of elongate circular cross-section wire formed of a high strength material with limited flexibility under normal operating conditions. Various alloys of steel would be one suitable material. Typically, the diameter of these wire elements would be uniform throughout the face shield 10, but could optionally be varied. As an option to wire, the upper portion could be formed as a surface with an opening therein having a similar size and function to the opening 35 of the various embodiment and options identified above.

While the face shield 10 could be provided with some form of fastener for attaching to the hard hat H, such as utilization of an adhesive, mechanical fasteners, magnets, hook and loop fasteners, or other fasteners for securing the face shield 10 to the hard hat H, most preferably, the face shield 10 merely rests upon the hard hat H, with the top loop 30 engaging a portion of the dome D or brim B, such as near the crease C of the hard hat H, and with the weight of the face shield 10 then carried by the hard hat H.

To keep the face shield 10 in place, especially when the forward portion 50 thereof is impacted from the front, a chinstrap 80 is preferably provided. This chin strap 80 can extend downwardly from eyelets 47 coupled to the second loop 40, or otherwise to other parts of the upper portion 20. The chinstrap 80 can include ends 82 engaging each of these eyelets 47. If multiple eyelets 47 are provided at ends 82 of the chinstrap 80, junctions 84 are preferably provided which bring these multiple ends 82 together, before spanning a space under a chin of the wearer as a single length of flexible material. Most preferably, an adjuster 86 is provided to adjust the length of the chinstrap 80. A clasp 88 is also preferably provided for opening and closing the chinstrap 80 (along arrow A of FIG. 4). A button 89 can be provided on the clasp 88 which can be pushed manually to cause the clasp 88 male portion to selectively engage or release a female portion of the clasp 88. Various other forms of chinstraps 80 could alternatively be provided, such as elongate length of elastic material with no clasp or adjuster. The chinstrap 80 could be utilized alone or along with a chinstrap for the hard hat H, if such a chinstrap is provided with the hard hat H.

Figure 1:
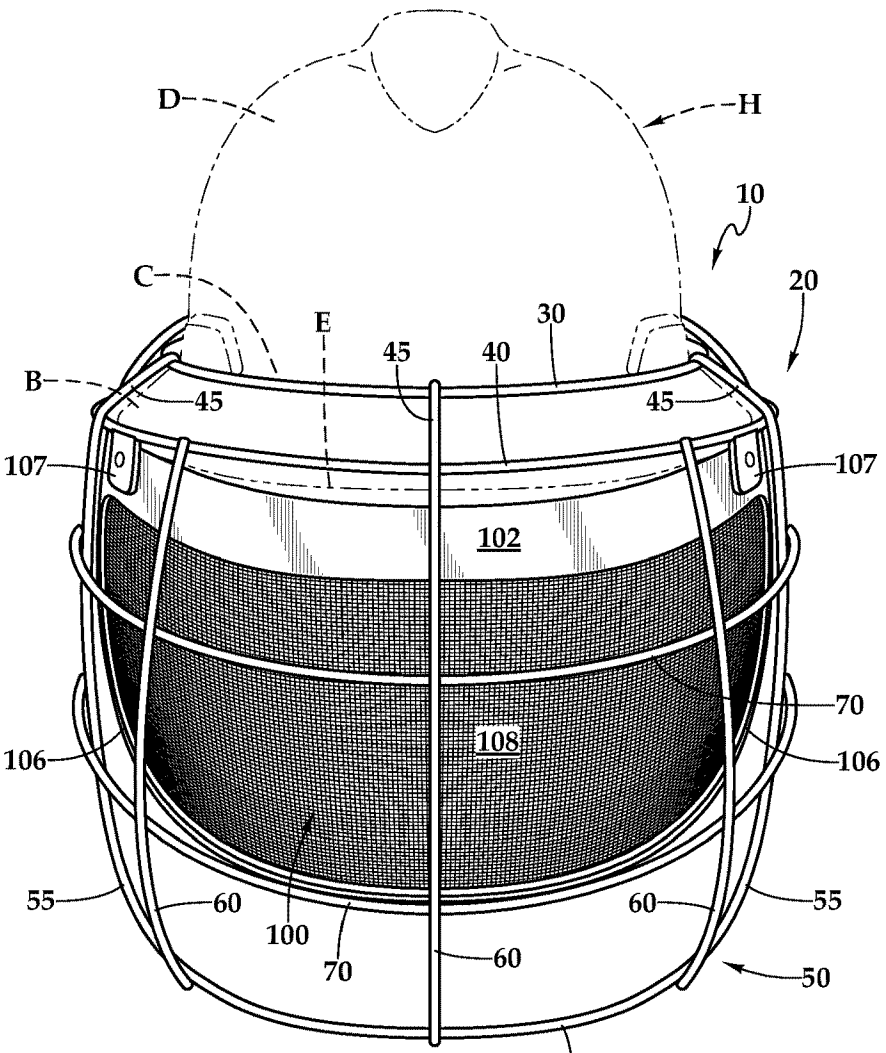
FIG. 1 is a front elevation view of the face shield of this invention shown in position upon a hard hat, with the hard hat shown in broken lines, and with an optional visor attached to the face shield.
Figure 4:
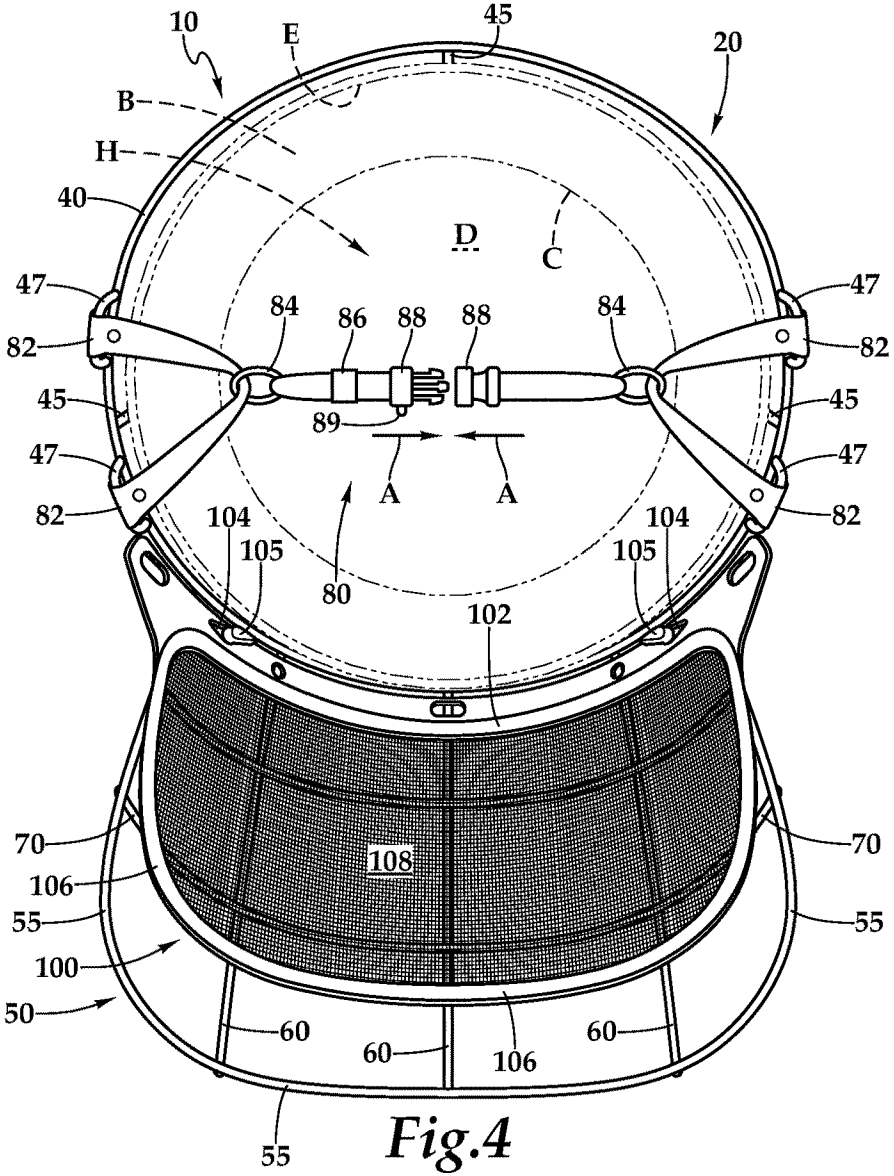
FIG. 4 is a bottom plan view of that which is shown in FIG. 1, and showing details of a chin strap associated with the face shield.

With particular reference to FIGS. 1, 5 and 6, details of the forward portion 50 of the face shield 10 are described, according to this exemplary embodiment. The forward portion 50 provides a preferred form of mask for protecting a face of a wearer from objects which might strike the face of the wearer from the front. This forward portion 50 preferably includes a perimeter 55 which defines lateral sides and a lower edge of the forward portion 50. This perimeter 55 is preferably sufficiently large to protect a face of a wearer fully. In this exemplary embodiment, the lateral width of the forward portion 50 is similar to a diameter of the upper portion 20. While the forward portion 50 could be formed in a variety of different ways, in this exemplary embodiment the forward portion 50 is formed by wire elements similar to how the upper portion 20 is formed, but with different orientations for the individual wire elements. In this embodiment, the forward portion 50 include columns 60 which preferably extend substantially within vertical planes, and with ribs 70 extending laterally relative to the columns 60. Joints between the ribs 70 and columns 60 can be welded together or otherwise coupled if desired. In this exemplary embodiment, three columns 60 are provided within the forward portion 50 and inboard of the perimeter 55, and two ribs 70 are provided which extend substantially horizontally, or otherwise extend laterally from the columns 60. As an alternative, one or more of the columns 60 or ribs 70 could be formed in a manner other than from wire, such as molded composite elements, such as formed of fiberglass, carbon fiber, high strength plastic, or other suitable materials for protecting a face of a wearer from impact by objects from the front.

With particular reference to FIGS. 1 and 4-8, details of an optional visor 100 are described according to one form of this exemplary embodiment. The visor 100 provides protection for flying particles which would pass between columns 60 and ribs 70 or other parts of the forward portion 50 of the face shield 10, such as sparks, splinters, pebbles, fragments of items being cut, or other debris. The visor 100 is depicted as including a mesh 108 of fine wire or fabric elements, which are sufficiently thin and loosely attached to each other to allow for viewing therethrough. As an alternative to this mesh 108, a clear plastic layer could be provided, or clear layer of some other material. This mesh 108 or other at least partially transparent protective layer is preferably supported by an upper band 102 and a perimeter band 106 extending from the upper band 102 to provide lateral sides and a lower edge to the overall visor 100.

Fastener ports 104 are preferably located within the upper band 102. Fastener posts 105 are coupled to brackets 107 affixed to the second loop 40 of the upper portion 20, or otherwise attached to some part of the upper portion 20. These fastener posts 105 preferably have an asymmetrical shape and the fastener ports 104 preferably have a corresponding asymmetrical shape. The fastener posts 105 are preferably rotatable relative to the brackets 107 (along arrow G of FIG. 8). The faster posts 105 can thus be rotated into and out of alignment with a geometry of the fastener ports 104. A first and a second fastener post 105 on the upper portion 20 can pass through two fastener ports 104 in the upper band 102 of the visor 100 at the right place to align with the two posts 105 of the upper portion 20 of the face shield 10, and then the fastener posts 105 can be rotated (along arrow G of FIG. 8) to capture the visor 100 adjacent to the upper portion 20 of the face shield 10. The visor 100 can thus be held in place inboard of the forward portion 50 of the face shield 10. For removal of the visor 100, this procedure can be reversed.

With particular reference to FIGS. 9-14, details of an alternative face shield 110 are described. This alternative face shield 110 is configured to best accommodate a hard hat H which has a brim B which is wider at a bill V extending from the crease C to a front edge F on a forward portion of the hard hat H (FIG. 14). This alternate face shield 110 is similar to the face shield 10 of the first exemplary embodiment, except where particularly distinctly described herein. An upper portion 120 can be provided in a variety of different configurations, but in this embodiment includes a top loop 130 surrounding an opening 135. A front loop segment 140 extends forward of the top loop 130, but only on a forward portion of the top loop 130, and preferably slightly below the top loop 130. Lateral elements 145 extend from the top loop 130 to the front loop segment 140 to more securely hold the front loop segment 140 to the top loop 130. The front loop segment 140 preferably is shaped and sized to follow a perimeter of the bill B on a forward portion of the brim B of the hard hat H, so that the front loop segment 140 generally follows the front edge F of the bill B. Eyelets 147 can be provided on portions of the top loop 130 and/or front loop segment 140 to accommodate a chinstrap 80 such as that described above.

The forward portion 150 is generally similar to the forward portion 50 of the first exemplary embodiment described above. This forward portion 150 includes a perimeter 155 and includes columns 160 which are preferably oriented within mostly vertical planes and ribs 170 which are preferably oriented extending lateral to the columns 160 and shown extending generally horizontally in this one embodiment of the alternate face shield 110. If desired, the perimeter 155 can be swept rearwardly in a more pronounced fashion on the forward portion 150 then is provided for the perimeter 55 associated with the forward portion 50 of the face shield 10 of the first exemplary embodiment. In this way, even though the front edge F of the bill V of the hard hat H places upper parts of the forward portion 150 more forwardly relative to a face of a wearer of the hard hat H, by sweeping back lateral sides of the perimeter 155, this allows for greater protection for sides of a face of the wearer then would be the case if the perimeter 155 were not swept back in a pronounced fashion at lateral sides thereof.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A face protection system, comprising in combination:

a hard hat having a dome and a brim, with a crease between said dome and said brim, said crease defining a transition angle between an outer surface of said dome and an upper surface of said brim, said brim extending to an edge defining a perimeter of said hard hat;

at least one loop surrounding a majority of an opening, said opening at least as large as a portion of said dome, said opening smaller than said perimeter of said hard hat;

said dome positioned at least partially up into said opening with said loop against and resting upon said hard hat;

a mask coupled to said loop and extending down from said at least one loop, said mask located on a front side of said hard hat to protect from impacts coming from a forward direction; and wherein said opening is larger than all of said dome, such that said dome fits entirely up into said opening, at least portions of said brim larger than said opening, such that said brim cannot fit up through said opening and said at least one loop rests at least partially upon said brim of said hard hat.

2. The system of claim 1 wherein said opening matches said crease in size and shape.

3. The system of claim 1 wherein said at least one loop completely surrounds said opening.

4. The system of claim 1 wherein a chin strap is coupled to portions of said at least one loop at at least two locations on lateral sides of said hard hat, said chin strap having a length to extend under a chin of a wearer of the hard hat.

5. The system of claim 1 wherein a visor is removably attachable inboard of said mask.

6. A face protection system, comprising in combination:

a hard hat having a dome and a brim, with a crease between said dome and said brim, said crease defining a transition angle between an outer surface of said dome and an upper surface of said brim, said brim extending to an edge defining a perimeter of said hard hat;

at least one loop surrounding a majority of an opening, said opening at least as large as a portion of said dome, said opening smaller than said perimeter of said hard hat;

said dome positioned at least partially up into said opening with said loop against and resting upon said hard hat;

a mask coupled to said loop and extending down from said at least one loop, said mask located on a front side of said hard hat to protect from impacts coming from a forward direction;

wherein said at least one loop completely surrounds said opening; and wherein said at least one loop defines a first loop, with a second loop coupled to said first loop and located outboard of said first loop, said second loop sized larger than said first loop and located below said first loop, and with said mask connected to said second loop and coupled to said first loop through said second loop.

7. The system of claim 6 wherein said mask includes a plurality of columns extending down from said second loop.

8. The system of claim 7 wherein a plurality of ribs extend laterally between said plurality of columns, said ribs joined to said columns.

9. The system of claim 8 wherein said columns, said ribs, said first loop and said second loop are each formed of wires.

10. A face protection system, comprising in combination:

a hard hat having a dome and a brim, with a crease between said dome and said brim, said crease defining a transition angle between an outer surface of said dome and an upper surface of said brim, said brim extending to an edge defining a perimeter of said hard hat;

at least one loop surrounding a majority of an opening, said opening at least as large as a portion of said dome, said opening smaller than said perimeter of said hard hat;

said dome positioned at least partially up into said opening with said loop against and resting upon said hard hat;

a mask coupled to said loop and extending down from said at least one loop, said mask located on a front side of said hard hat to protect from impacts coming from a forward direction; and wherein said brim of said hard hat is limited to a front of said hard hat, said mask connected to a front edge of said brim.

11. A face shield and hard hat comprising in combination:

a hard hat;

at least one loop surrounding a majority of an opening, said opening at least as large as a portion of a dome of the hard hat, said opening smaller than a perimeter of said hard hat, such that the dome can fit at least partially up into said opening with said loop against and resting upon the hard hat;

a mask coupled to said loop and extending down from said at least one loop, said mask located on a front side of the at least one loop to protect from impacts coming from a forward direction; and wherein said at least one loop defines a first loop, with a second loop coupled to said first loop and located outboard of said first loop, said second loop sized larger than said first loop and located below said first loop, and with said mask connected to said second loop.

12. The face shield and hard hat of claim 11 wherein said opening is larger than all of the dome of the hard hat, such that the dome can fit entirely up into said opening, at least portions of a brim of the hard hat larger than said opening, such that the brim cannot fit up through said opening.

13. The face shield and hard hat of claim 11 wherein said at least one loop completely surrounds said opening.

14. The face shield and hard hat of claim 11 wherein said mask includes a plurality of columns extending down from said second loop.

15. The face shield and hard hat of claim 14 wherein a plurality of ribs extend laterally between said plurality of columns, said ribs joined to said columns and wherein said columns and said ribs are formed of wires.

16. The face shield and hard hat of claim 11 wherein a chin strap is coupled to portions of said at least one loop at least indirectly at at least two attachment locations on lateral sides of said at least one loop, said chin strap longer than a distance between said at least two attachment locations.

17. A method for protecting a face of a hard hat wearer, the method including the steps of:

donning a hard hat having a dome and a brim, with a crease between the dome and the brim, the crease defining a transition in angle between an outer surface of the dome and an upper surface of the brim, the brim extending to an edge defining a perimeter of the hard hat;

placing a face shield upon the hard hat, the face shield including at least one loop surrounding a majority of an opening, the opening at least as large as a portion of the dome of the hard hat, the opening smaller than the perimeter of the hard hat, such that the dome fits at least partially into the opening but the hard hat cannot fit entirely through the opening, wherein the at least one loop defines a first loop, with a second loop coupled to the first loop and located outboard of the first loop, the second loop sized larger than the first loop and located below the first loop, and with a mask connected to the second loop; and orienting the face shield so that the mask of the face shield extends down from the second loop on a front side of the second loop, the mask coupled to the first loop through the second loop, the mask located to be in front of a face of a wearer of the hard hat to protect the face from impacts coming at the face from a forward direction.

18. The method of claim 17 wherein the hard hat has the brim of the hard hat limited to a front of the hard hat, and wherein the mask of the face shield extends down from the edge of the hard hat in front of the brim of the hard hat.

* * * * *